US010132041B2

(12) United States Patent
Hermans et al.

(10) Patent No.: US 10,132,041 B2
(45) Date of Patent: Nov. 20, 2018

(54) SOFT TISSUE COMPRISING SOUTHERN SOFTWOOD

(71) Applicant: Kimberly-Clark Worldwide, Inc., Neenah, WI (US)

(72) Inventors: Michael Alan Hermans, Neenah, WI (US); Richard Louis Underhill, Neenah, WI (US); Kayla Elizabeth Rouse, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/549,801

(22) PCT Filed: Feb. 19, 2016

(86) PCT No.: PCT/US2016/018676

§ 371 (c)(1),
(2) Date: Aug. 9, 2017

(87) PCT Pub. No.: WO2016/134256

PCT Pub. Date: Aug. 25, 2016

(65) Prior Publication Data

US 2018/0044859 A1 Feb. 15, 2018

Related U.S. Application Data

(60) Provisional application No. 62/118,489, filed on Feb. 20, 2015.

(51) Int. Cl.

| | |
|---|---|
| ***D21H 27/00*** | (2006.01) |
| ***D21H 11/04*** | (2006.01) |
| ***D21H 27/30*** | (2006.01) |
| ***D21H 27/38*** | (2006.01) |

(52) U.S. Cl.
CPC ..... *D21H 27/005* (2013.01); *D21H 11/04* (2013.01); *D21H 27/002* (2013.01); *D21H 27/30* (2013.01); *D21H 27/38* (2013.01)

(58) Field of Classification Search
CPC .... D21H 27/005; D21H 27/002; D21H 11/04; D21H 27/30; D21H 27/38
See application file for complete search history.

(56) References Cited

U.S. PATENT DOCUMENTS

| | | | | |
|---|---|---|---|---|
| 5,562,805 | A | 10/1996 | Kamps et al. | |
| 6,231,721 | B1 * | 5/2001 | Quick | A61F 13/53 162/164.1 |
| 6,638,884 | B2 * | 10/2003 | Quick | A61F 13/53 162/164.1 |
| 6,719,862 | B2 * | 4/2004 | Quick | A61F 13/53 156/60 |
| 2001/0018308 | A1 * | 8/2001 | Quick | A61F 13/53 442/417 |
| 2003/0056916 | A1 | 3/2003 | Horenziak et al. | |
| 2003/0207641 | A1 * | 11/2003 | Quick | A61F 13/53 442/413 |
| 2004/0192136 | A1 | 9/2004 | Gusky et al. | |
| 2007/0137807 | A1 | 6/2007 | Schulz et al. | |
| 2007/0224419 | A1 | 9/2007 | Sumnicht et al. | |
| 2008/0014428 | A1 | 1/2008 | Vinson et al. | |
| 2010/0065234 | A1 | 3/2010 | Klerelid et al. | |
| 2010/0065237 | A1 | 3/2010 | Trochlil | |
| 2013/0029106 | A1 | 1/2013 | Lee et al. | |
| 2013/0071655 | A1 | 3/2013 | Zwick et al. | |
| 2014/0004326 | A1 * | 1/2014 | Petersen | D04H 1/425 428/219 |
| 2014/0096924 | A1 | 4/2014 | Rekoske et al. | |
| 2014/0150339 | A1 * | 6/2014 | Underhill | A01C 21/00 47/58.1 R |
| 2014/0284010 | A1 | 9/2014 | Shannon | |
| 2016/0145809 | A1 * | 5/2016 | Hermans | A47K 10/16 162/111 |
| 2016/0244916 | A1 * | 8/2016 | Neogi | D21H 27/007 |
| 2016/0319488 | A1 * | 11/2016 | Hermans | D21H 27/005 |
| 2016/0355987 | A1 * | 12/2016 | Hermans | D21H 27/007 |
| 2016/0362843 | A1 * | 12/2016 | Hermans | D21H 11/04 |
| 2017/0204568 | A1 * | 7/2017 | Timm | D21H 25/005 |
| 2017/0284029 | A1 * | 10/2017 | Hermans | A47K 10/16 |
| 2018/0044859 | A1 * | 2/2018 | Hermans | D21H 11/04 |
| 2018/0135248 | A1 * | 5/2018 | Collins | D21H 27/002 |
| 2018/0135253 | A1 * | 5/2018 | Shannon | D21H 27/002 |
| 2018/0142420 | A1 * | 5/2018 | Rouse | D21H 27/005 |

FOREIGN PATENT DOCUMENTS

| | | | | |
|---|---|---|---|---|
| CN | 103764904 | A | 4/2014 | |
| CN | 103814173 | A | 5/2014 | |
| WO | WO-2008068651 | A2 * | 6/2008 | D21H 21/18 |
| WO | WO-2009156888 | A2 * | 12/2009 | D21F 11/14 |
| WO | WO-2016134256 | A1 * | 8/2016 | D21H 11/04 |

* cited by examiner

*Primary Examiner* — Jose A Fortuna
(74) *Attorney, Agent, or Firm* — Kimberly-Clark Worldwide, Inc.

(57) ABSTRACT

The present invention relates to soft, durable tissue products comprising Southern softwood fibers and more particularly low-coarseness Southern softwood fibers. The inventive tissue products generally comprise little or no Northern softwood kraft fibers yet have comparable or better tissue product properties such as a TS750 value (a measure of tissue softness) less than about 50 dB V2 rms and a CD Tear Index (a measurement of tissue durability) greater than about 13.

20 Claims, No Drawings

SOFT TISSUE COMPRISING SOUTHERN SOFTWOOD

BACKGROUND OF THE DISCLOSURE

Tissue products, such as facial tissues, paper towels, bath tissues, napkins, and other similar products, are designed with several important properties in mind. For example, the products should have good bulk, a soft feel, and should be strong and durable. Unfortunately, however, when steps are taken to increase one property of the product, other properties are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on the coarseness of pulp fibers. Pulps having fibers with low-coarseness are desirable because tissue paper made from fibers having a low-coarseness can be made softer than similar tissue paper made from fibers having a high coarseness. To optimize surface softness even further, premium tissue products usually comprise layered structures where the low-coarseness fibers are directed to the outside layer of the tissue sheet with the inner layer of the sheet comprising longer, coarser fibers.

Unfortunately, the need for softness is balanced by the need for durability. Durability in tissue products can be defined in terms of tensile strength, tensile energy absorption (TEA), burst strength and tear strength. Typically tear, burst and TEA will show a positive correlation with tensile strength while tensile strength, and thus durability, and softness are inversely related. Thus the paper maker is continuously challenged with the need to balance the need for softness with a need for durability. Unfortunately, tissue paper durability generally decreases as the fiber length is reduced. Therefore, simply reducing the pulp fiber length can result in an undesirable trade-off between product surface softness and product durability.

Besides durability long fibers also play an important role in overall tissue product softness. While surface softness in tissue products is an important attribute, a second element in the overall softness of a tissue sheet is stiffness. Stiffness can be measured from the tensile slope of stress—strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low-coarseness long fibers, such as those provided by Northern softwood kraft (NSWK) fibers typically supply the best combination of durability and softness in tissue products when those fibers are used in combination with hardwood kraft fibers such as eucalyptus hardwood kraft fibers (EHWK). While NSWK fibers have a higher coarseness than EHWK fibers, their small cell wall thickness relative to lumen diameter combined with their long length makes them the ideal candidate for optimizing durability and softness in tissue.

Unfortunately supply of NSWK is under significant pressure both economically and environmentally. As such, prices of NSWK have escalated significantly creating a need to find alternatives to optimize softness and strength in tissue products. Alternatives, however, are limited. For example, Southern softwood kraft (SSWK) may only be used in limited amounts in the manufacture of tissue products because its high coarseness results in stiffer, harsher feeling products than NSWK. Thus, to-date SSWK is not widely used in the manufacture of premium tissue products, which must be both soft and strong.

Therefore, what is needed is a long fiber having relatively low-coarseness that may be used to manufacture a tissue product that is both soft and strong.

SUMMARY OF THE DISCLOSURE

The present inventors have surprisingly discovered that a soft and strong tissue product may be produced using a fiber furnisher comprising Southern softwood (SSW) fibers and more particularly low-coarseness Southern softwood (low-coarseness SSW) fibers and still more preferably low-coarseness Southern softwood kraft (low-coarseness SSWK) fibers. The tissue products of the present invention have properties comparable or better than those produced using conventional softwood fibers, such as Northern softwood kraft (NSWK) fibers. Accordingly, in certain preferred embodiments, SSW fibers may replace at least about 50 percent of the NSWK in the tissue product, more preferably at least about 75 percent and still more preferably all NSWK without negatively effecting the tissue product's softness and durability.

Accordingly, in certain embodiments the tissue products may comprise a multi-layered tissue web where one or more of the layers comprise low-coarseness SSW fibers and NSWK fibers and/or conventional SSWK fibers. Blending low-coarseness SSW fibers with NSWK fibers and/or conventional SSWK fibers may improve the physical properties of the tissue product, such as increased softness and durability, while reducing the cost of manufacture. Thus, in certain embodiments, the invention provides a tissue product comprising from about 5 to about 30 percent, by weight of the product, low-coarseness SSW fibers and from about 5 to about 30 percent, by weight of the product, conventional SSW fibers. The blend of low-coarseness SSW fibers and conventional SSW fibers may be selectively incorporated into the non-skin contacting layer of a multi-layered product, such as the middle layer of a three layered tissue product. Moreover, the blend of low-coarseness SSW fibers and conventional SSW fibers may displace substantially all of the NSWK in a tissue product while improving the product properties, such as improved durability and increased softness.

In other embodiments the present invention provides a tissue product that is soft, such as a tissue product having a TS750 value less than about 50 dB V2 rms and more preferably less than about 48 dB V2 rms, such as from about 40 to about 50 dB V2 rms, and durable, such as a tissue product having a CD Tear Index greater than about 13, and more preferably greater than about 14, such as from about 13 to about 15.

In another embodiment the present invention provides a tissue product having a CD Tear Index greater than about 13, a Burst Index greater than about 7.5, a CD TEA Index greater than about 6.5 and a TS750 value from about 42 to about 50 dB V2 rms In still other embodiments the present invention provides a tissue product having a GMT from about 700 to about 1200 g/3" and more preferably from about 700 to about 1000 g/3" and still more preferably from about 750 to about 900 g/3", a Durability Index greater than about 28, such as from about 28 to about 45, and a TS750 value less than about 50 dB V2 rms.

In yet another embodiment the present invention provides a tissue product comprising at least about 5 percent, by weight of the product, such as from about 5 to about 30 percent, low-coarseness SSWK fibers, the tissue product having a GMT from about 700 to about 1200 g/3" a Durability Index greater than about 30, such as from about 30 to about 45, and a TS750 value less than about 50 dB V2 rms.

DEFINITIONS

As used herein, the term "fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
x=fiber length
$n_i$=number of fibers having length $x_i$
n=total number of fibers measured.

As used herein, the term "coarseness" refers to the fiber mass per unit of unweighted fiber length reported in units of milligrams per one hundred meters of unweighted fiber length (mg/100 m) as measured using a suitable fiber coarseness measuring device such as the above mentioned Kajaani FS-200 analyzer. The coarseness of the pulp is an average of three coarseness measurements of three fiber specimens taken from the pulp. The operation of the analyzer for measuring coarseness is similar to the operation for measuring fiber length described above.

As used herein, the term "basis weight" generally refers to the bone dry weight per unit area of a tissue and is generally expressed as grams per square meter (gsm). Basis weight is measured using TAPPI test method T220.

As used herein, the term "Burst Index" refers to the dry burst peak load (typically having units of grams) at a relative geometric mean tensile strength (typically having units of g/3") as defined by the equation:

$$\text{Burst Index} = \frac{\text{Dry Burst Peak Load (g)}}{GMT\ (\text{g}/3'')} \times 10$$

While Burst Index may vary, tissue products prepared according to the present disclosure generally have a Burst Index greater than about 7.5, more preferably greater than about 8.0 and still more preferably greater than about 8.5, such as from about 7.5 to about 10.0.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "CD TEA Index" refers the CD tensile energy absorption (typically having units of g·cm/cm$^2$) at a relative geometric mean tensile strength (typically having units of g/3") as defined by the equation:

$$CD\ \text{TEA Index} = \frac{CD\ \text{TEA (g}\cdot\text{cm/cm2)}}{GMT\ (\text{g}/3'')} \times 1{,}000$$

While the CD TEA Index may vary, tissue products prepared according to the present disclosure generally have a CD TEA Index greater than about 6.0, more preferably greater than about 6.5 and still more preferably greater than about 7.0, such as from about 6.0 to about 8.0.

As used herein, the term "Durability Index" refers to the sum of the CD Tear Index, the Burst Index and the CD TEA Index, and is an indication of the durability of the product at a given tensile strength. Durability Index is defined by the equation:

Durability Index=CD Tear Index+Burst Index+CD TEA Index

While the Durability Index may vary, tissue products prepared according to the present disclosure generally have a Durability Index value of about 28 or greater, more preferably about 32 or greater and still more preferably about 35 or greater, such as from about 28 to about 48.

As used herein, the terms "geometric mean tensile" and "GMT" refer to the square root of the product of the machine direction tensile strength and the cross-machine direction tensile strength of the tissue product. While the GMT may vary, tissue products prepared according to the present disclosure generally have a GMT greater than about 700 g/3", more preferably greater than about 750 g/3" and still more preferably greater than about 800 g/3", such as from about 700 to about 1200 g/3".

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g).

As used herein, the term "geometric mean slope" (GM Slope) generally refers to the square root of the product of machine direction slope and cross-machine direction slope. GM Slope generally is expressed in units of kilograms (kg).

As used herein, the term "low-coarseness Southern softwood" (low-coarseness SSW) refers to a fiber derived from a pine in the *Pinus* subgenus including, for example, *P. taeda, P. elliotti, P. palustris, P. pungens, P. rigida, P. serotina, P. muricata* and *P. radiate*, the fiber having a coarseness less than about 21 mg/100 m, such as from about 16 to about 21 mg/100 m, and more preferably from about 17 to about 20.5 mg/100 m, and a fiber length from about 2.0 to about 3.0 mm, and more preferably from about 2.2 to about 2.7 mm.

As used herein, the term "Stiffness Index" refers to GM Slope (typically having units of kg), divided by GMT (typically having units of g/3").

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index may vary, tissue products prepared according to the present disclosure generally have a Stiffness Index less than about 10.0, more preferably less than about 9.0 and still more preferably less than about 8.0 such as from about 6.0 to about 10.0.

As used herein, the term "Tear Index" refers to the CD Tear Strength (typically expressed in grams) at a relative geometric mean tensile strength (typically having units of g/3") as defined by the equation:

$$CD\ \text{Tear Index} = \frac{CD\ \text{Tear (g)}}{GMT\ (\text{g}/3'')} \times 1{,}000$$

While the CD Tear Index may vary, tissue products prepared according to the present disclosure generally have a CD Tear Index greater than about 13.0, more preferably greater than about 14.0 and still more preferably greater than about 15.0 such as from about 13.0 to about 18.0.

As used herein, the term "sheet bulk" refers to the quotient of the caliper (generally having units of μm) divided by the bone dry basis weight (generally having units of gsm). The resulting sheet bulk is expressed in cubic centimeters per gram (cc/g). Tissue products prepared according to the present invention generally have a sheet bulk greater than about 8 cc/g, more preferably greater than about 10 cc/g and still more preferably greater than about 12 cc/g, such as from about 8 to about 20 cc/g and more preferably from about 12 to about 18 cc/g.

As used herein, the terms "TS750" and "TS750 value" refer to the output of the EMTEC Tissue Softness Analyzer (commercially available from Emtec Electronic GmbH, Leipzig, Germany) as described in the Test Methods section. TS750 has units of dB V2 rms, however, TS750 may be referred to herein without reference to units.

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

DETAILED DESCRIPTION OF THE DISCLOSURE

In general, the present disclosure relates to tissue products comprising Southern softwood (SSW) fibers and more preferably low-coarseness SSW fibers. The SSW fibers used in the manufacture of the inventive tissue products may displace a portion, and in certain embodiments all, of the long fiber length fibers, such as Northern softwood kraft (NSWK) fibers, without significantly impairing important tissue physical properties such as durability, strength and softness. For example, in certain embodiments the inventive tissue products comprise low-coarseness SSW fibers and less than about 5 percent, by weight of the tissue product, NSWK, yet have improved durability and softness relative to a comparable tissue product comprising 20 percent NSWK. Even more surprising is that in certain embodiments NSWK may be entirely replaced by low-coarseness SSWK fibers and the tissue product properties may be improved.

The ability to replace a significant amount of NSWK, and in certain embodiments all of the NSWK, with SSW and maintain or improve tissue product properties is surprising provided that SSW has traditionally been unsuitable for use in manufacturing premium tissue products because of its high coarseness. However, it has now been discovered that a SSW having reduced coarseness may be used in the manufacture of soft and strong tissue products. The discovery is particularly surprising because the reduction in fiber coarseness is only moderate, such as less than about 10 percent, compared to conventional SSWK. While being reduced relative to conventional SSWK, the coarseness of low-coarseness SSW fibers is still greater than NSWK as can be seen in Table 1, below.

TABLE 1

| Fiber Type | Fiber Length (mm) | Coarseness (mg/100 m) |
|---|---|---|
| Conventional SSWK | 2.35 | 21.3 |
| Low-coarseness SSWK | 2.53 | 19.3 |
| NSWK Pulp Fiber | 2.25 | 14.8 |
| *Eucalyptus* Kraft Pulp Fiber | 0.76 | 8.95 |

While the low-coarseness SSW fibers are higher in coarseness compared to NSWK fibers they may replace NSWK fibers in tissue products without impairing important physical properties such as durability, strength and softness. Even more surprisingly, in certain embodiments, substitution of NSWK fibers with low-coarseness SSW fibers may actually increase softness (measured as TS750) while also improving durability (measured as Durability Index).

The improved properties of the inventive tissue products are further illustrated in Table 2 which compares the change in various physical properties relative to comparable tissue products comprising NSWK. All tissues shown in Table 2 are single-ply products having a basis weight of about 36 gsm, a GMT of about 700 g/3" and a softwood content of about 34 percent, based upon the total weight of the tissue product. While conventional SSWK (SSWK) improves durability relative to NSWK there is a significant negative impact on softness. Surprisingly low-coarseness SSW (LC SSWK) improves durability even more than conventional SSWK while also improving softness (lower TS750 value indicates a softer tissue).

TABLE 2

| | NSWK | SSWK | LC SSWK | SSWK Delta | LC SSWK Delta |
|---|---|---|---|---|---|
| CD Tear Index | 12.08 | 13.66 | 13.57 | 13.1% | 12.4% |
| CD TEA Index | 5.65 | 5.03 | 6.48 | −11.0% | 14.8% |
| Burst Index | 7.14 | 8.00 | 8.57 | 12.0% | 20.0% |
| Durability Index | 24.87 | 26.68 | 28.63 | 7.3% | 15.1% |
| TS750 | 54.7 | 76.5 | 47.2 | 39.9% | −13.7% |

Accordingly, in certain embodiments the disclosure provides a tissue product having a TS750 value less than about 50 dB V2 rms and a Durability Index greater than about 25 and more preferably a Durability Index greater than about 28 and still more preferably a Durability Index greater than about 30, such as from about 30 to about 35.

In one particularly preferred embodiment the tissue product comprises a through-air dried web comprising less than about 5 percent, by weight of the web, NSWK, the tissue product having a TS750 value from about 40 to about 50 dB V2 rms and a Durability Index from about 30 to about 45. In still other embodiments the invention provides a tissue product comprising a through-air dried web having from about 10 to about 40 percent, by weight of the web, SSW fibers, the tissue product having a TS750 from about 40 to about 50 dB V2 rms and a Durability Index from about 30 to about 45.

In a particularly preferred embodiment the tissue product comprises a multi-layered through-air dried web wherein low-coarseness SSW fiber is selectively disposed in only one of the layers such that the low-coarseness SSW fiber is not brought into contact with the user's skin in-use. For example, in one embodiment the tissue web may comprise a two layered web wherein the first layer consists essentially of hardwood kraft pulp fibers and is substantially free of low-coarseness SSWK and the second layer comprises low-coarseness SSW, wherein the low-coarseness SSWK comprises at least about 50 percent by weight of the second layer, such as from about 50 to about 100 percent by weight of the second layer. It should be understood that, when referring to a layer that is substantially free of low-coarseness SSW fibers, negligible amounts of the fiber may be present therein, however, such small amounts often arise from the low-coarseness SSW fibers applied to an adjacent layer, and do not typically substantially affect the softness or other physical characteristics of the web.

The tissue webs may be incorporated into tissue products that may be either single or multi-ply, where one or more of the plies may be formed by a multi-layered tissue web having low-coarseness SSW fibers selectively incorporated in one of its layers. In one embodiment the tissue product is constructed such that the low-coarseness SSW fibers are not brought into contact with the user's skin in-use. For example, the tissue product may comprise two multi-layered through-air dried webs wherein each web comprises a first fibrous layer substantially free from low-coarseness SSW fibers and a second fibrous layer comprising low-coarseness SSW fibers. The webs are plied together such that the outer surface of the tissue product is formed from the first fibrous layers of each web and the second fibrous layer comprising the low-coarseness SSW fibers is not brought into contact with the user's skin in-use.

Generally low-coarseness SSW fibers useful in the present invention are derived from pines in the *Pinus* subgenus. Suitable species within the *Pinus* subgenus include, for example, *P. taeda, P. elliotti, P. palustris, P. pungens, P. rigida, P. serotina, P. muricata* and *P. radiata*. Particularly preferred are *P. taeda, P. elliotti*, and *P. palustris*. Further, it is to be understood that the compositions disclosed herein are not limited to containing any one species of low-coarseness SSW fiber and may comprise a blend of low-coarseness SSW fibers derived from two or more species, such as a blend of fibers derived from *P. taeda, P. elliotti*, and *P. palustris*.

In certain embodiments the low-coarseness SSW fibers are derived from pines within the *Pinus* subgenus which are less than about 14 years old and more preferably less than about 12 and still more preferably less than about 10 years, such as from about 8 to about 12 years. Generally pines within the *Pinus* subgenus less than 14 years old comprise a large percentage of juvenile wood and as such have fibers with lower coarseness relative to more mature pines. In other embodiments low-coarseness SSW fibers are derived from the corewood portion of the tree, i.e., the portion of the tree comprising the first 10 to 12 growth layers from the pith. Corewood may be produced by selectively removing the outer portion of the tree, such as by removing the corewood, or by selecting the top portion of the tree which is generally less than about 10 to 12 growth layers from pith to bark.

Once the appropriate fiber source is identified suitable low-coarseness SSW fiber may be produced by any appropriate method known in the art. In one embodiment low-coarseness SSW fiber is produced by well-known chemical pulping methods such as kraft, sulfite or soda/AQ pulping methods. In one preferred embodiment low-coarseness SSW fibers are produced by kraft pulping and have a fiber length greater than about 2.2 mm and more preferably greater than about 2.4 mm, such as from about 2.2 to about 2.8 mm. Further, the foregoing fibers preferably have a coarseness less than about 21 mg/100 m, such as from about 16 to about 21 mg/100 m, more preferably from about 17 to about 20.5 mg/100 m and still more preferably from about 18 to about 19.5 mg/100 m.

In a particularly preferred embodiment low-coarseness SSW fibers are utilized in the tissue web as a replacement for high fiber length wood fibers such as softwood fibers and more specifically NSWK. In one particular embodiment the low-coarseness SSW fibers are substituted for NSWK such that the total amount of NSWK, by weight of the tissue product, is less than about 10 percent and more preferably less than about 5 percent. In other embodiments it may be desirable to replace all of the NSWK with low-coarseness SSW fibers such that the tissue product is substantially free from NSWK. In other embodiments low-coarseness SSW fibers may be blended with conventional SSW fibers and the blended SSW fibers may be substituted for NSWK such that the total amount of NSWK, by weight of the tissue product, is less than about 10 percent and more preferably less than about 5 percent. The blend of low-coarseness SSW fibers and conventional SSW fibers may be such that the tissue product comprises, by weight of the tissue product, from about 5 to about 30 percent low-coarseness SSW fibers and from about 5 to about 30 percent conventional SSW fibers.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers, can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 60 pounds per ton (lb/T), in some embodiments, between about 5 to about 30 lb/T, and in some embodiments, between about 7 to about 13 lb/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lb/T, in some embodiments between about 3 to about 20 lb/T, and in some embodiments, between about 6 to about 15 lb/T of the dry weight of fibrous material. The debonder can be incorporated into any layer of the multi-layered tissue web.

In certain embodiments the debonder may possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and be either creped or uncreped. When forming multi-ply tissue products, the separate plies can be made from the same process or from different processes as desired.

TEST METHODS

TS750

TS750 was measured using an EMTEC Tissue Softness Analyzer ("TSA") (Emtec Electronic GmbH, Leipzig, Germany). The TSA comprises a rotor with vertical blades which rotate on the test piece applying a defined contact pressure. Contact between the vertical blades and the test piece creates vibrations, which are sensed by a vibration sensor. The sensor then transmits a signal to a PC for processing and display. The signal is displayed as a frequency spectrum. For measurement of TS7 and TS750 values the blades are pressed against the sample with a load of 100 mN and the rotational speed of the blades is 2 revolutions per second.

To measure TS750 a frequency analysis in the range of approximately 200 to 1000 Hz is performed with the amplitude of the peak occurring at 750 Hz being recorded as the TS750 value. The TS750 value represents the surface smoothness of the sample. A high amplitude peak correlates to a rougher surface. TS750 has units dB V2 rms.

Test samples were prepared by cutting a circular sample having a diameter of 112.8 mm. All samples were allowed to equilibrate at TAPPI standard temperature and humidity conditions for at least 24 hours prior to completing the TSA testing. Only one ply of tissue is tested. Multi-ply samples are separated into individual plies for testing. The sample is placed in the TSA with the softer (dryer or Yankee) side of the sample facing upward. The sample is secured and the measurements are started via the PC. The PC records, processes and stores all of the data according to standard TSA protocol. The reported values are the average of five replicates, each one with a new sample.

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tear

Tear testing was carried out in accordance with TAPPI test method T414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006") in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength of the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of $g \cdot cm/cm^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a 2-ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings has an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

Opacity

Opacity was measured using a TECHNIBRITE Micro TB-1C testing instrument, available from Technidyne Corporation, New Albany, Ind. according to the manufacturer's instructions and is reported as ISO Opacity (%).

EXAMPLES

Example 1

Single ply uncreped through-air dried (UCTAD) tissue webs were made generally in accordance with U.S. Pat. No. 5,607,551. The tissue webs and resulting tissue products were formed from various fiber furnishes including, eucalyptus hardwood kraft (EHWK), NSWK, conventional SSWK and low-coarseness SSWK.

The EWHK furnish was prepared by dispersing about 120 pounds (oven dry basis) EHWK pulp in a pulper for 30 minutes at a consistency of about 3 percent. The fibers were then transferred to a machine chest and diluted to a consistency of 1 percent.

The NSWK furnish was prepared by dispersing about 50 pounds (oven dry basis) of NSWK pulp in a pulper for 30 minutes at a consistency of about 3 percent. The fibers were then transferred to a machine chest and diluted to a consistency of 1 percent. In certain instances starch (Redibond 2038 A) was added to the NSWK machine chest as indicated in Table 3. The NSWK was not refined. The NSWK had a length-weighted fiber length of about 2.25 mm and a fiber coarseness of about 14.8 mg/100 m.

The conventional SSWK furnish was prepared by dispersing about 50 pounds (oven dry basis) of SSWK pulp in a pulper for 30 minutes at a consistency of about 3 percent. The fibers were then transferred to a machine chest and diluted to a consistency of 1 percent. In certain instances starch (Redibond 2038 A) was added to the SSWK machine chest as indicated in Table 3. In certain instances the SSWK pulp was also subjected to refining as indicated in Table 3. The conventional SSWK had a length-weighted fiber length of about 2.35 mm and a fiber coarseness of about 21 mg/100 m.

The low-coarseness SSWK furnish was prepared by dispersing about 50 pounds (oven dry basis) of low-coarseness SSWK pulp in a pulper for 25 minutes at a consistency of about 3 percent. The fibers were then transferred to a machine chest and diluted to a consistency of 1 percent. In certain instances starch (Redibond 2038 A) was added to the low-coarseness SSWK machine chest as indicated in Table 3. The low-coarseness SSWK was not refined. The low-coarseness SSWK had a length-weighted fiber length of about 2.5 mm and a fiber coarseness of about 19 mg/100 m.

TABLE 3

| Sample | Fiber | Redibond 2038 A (kg/ton) | Refining (min) |
|---|---|---|---|
| 1 | NSWK | 0 | — |
| 2 | NSWK | 2 | — |
| 3 | NSWK | 4 | — |
| 4 | Low-coarseness SSWK | 0 | — |
| 5 | Low-coarseness SSWK | 2.5 | — |
| 6 | Low-coarseness SSWK | 5 | — |
| 7 | Conventional SSWK | 0 | 2 |
| 8 | Conventional SSWK | 1 | 2 |
| 9 | Conventional SSWK | 2.25 | 2 |

The stock solutions were pumped to a 3-layer headbox after dilution to 0.75 percent consistency to form a three layered tissue web. EHWK fibers were disposed on the two outer layers and softwood fibers (NSWK, conventional SSWK or low-coarseness SSWK) were disposed in the middle layer. The relative weight percentage of the layers was 33%/34%/33%. The target basis weight for all codes was 40 gsm (as-is basis weight). The formed web was non-compressively dewatered and rush transferred to a transfer fabric traveling at a speed about 28 percent slower than the forming fabric. The transfer vacuum at the transfer to the TAD fabric was maintained at approximately 6 inches of mercury vacuum to control molding to a constant level. The web was then transferred to a throughdrying fabric, dried and wound into a parent roll. The parent rolls were then converted into 1-ply bath tissue rolls. Calendering was done with a steel-on-rubber setup. The rubber roll used in the converting process had a hardness of 40 P&J. The rolls were converted to a diameter of about 117 mm with Kershaw firmness target of about 6 mm and a target roll weight of about 400 grams. Samples were produced as described in Table 4, below.

TABLE 4

| Sample | Basis Weight (gsm) | Plies | EHWK (wt %) | NSWK (wt %) | Conventional SSWK (wt %) | Low-coarseness SSWK (wt %) |
|---|---|---|---|---|---|---|
| 1 | 36.5 | 1 | 66 | 34 | — | — |
| 2 | 36.3 | 1 | 66 | 34 | — | — |
| 3 | 34.3 | 1 | 66 | 34 | — | — |
| 4 | 35.7 | 1 | 66 | — | — | 34 |
| 5 | 36.2 | 1 | 66 | — | — | 34 |
| 6 | 35.2 | 1 | 66 | — | — | 34 |
| 7 | 37.5 | 1 | 66 | — | 34 | — |
| 8 | 36.8 | 1 | 66 | — | 34 | — |
| 9 | 37.0 | 1 | 66 | — | 34 | — |

The effect of low-coarseness SSWK fibers on various tissue strength and durability properties is summarized in the tables below.

TABLE 5

| Sample | GMT (g/3") | CD Tear (g) | CD Tear Index | CD TEA (g · cm/cm$^2$) | CD TEA Index | Peak Burst Strength (g) | Burst Index |
|---|---|---|---|---|---|---|---|
| 1 | 726 | 8.77 | 12.08 | 4.1 | 5.65 | 518 | 7.14 |
| 2 | 843 | 10.16 | 12.05 | 5.2 | 6.17 | 606 | 7.19 |
| 3 | 844 | 11.52 | 13.65 | 5.5 | 6.52 | 626 | 7.42 |
| 4 | 694 | 9.42 | 13.57 | 4.5 | 6.48 | 595 | 8.57 |
| 5 | 763 | 11.09 | 14.53 | 5.2 | 6.82 | 625 | 8.19 |
| 6 | 807 | 12.89 | 15.97 | 5.6 | 6.94 | 639 | 7.92 |
| 7 | 716 | 9.78 | 13.66 | 3.6 | 5.03 | 573 | 8.00 |
| 8 | 777 | 11.45 | 14.74 | 4.4 | 5.66 | 574 | 7.39 |
| 9 | 770 | 12.05 | 15.65 | 4.2 | 5.45 | 584 | 7.59 |

TABLE 6

| Sample | GMT (g/3") | MD Slope (kg) | CD Slope (kg) | GM Slope (kg) | Stiffness Index | Durability Index | TS750 |
|---|---|---|---|---|---|---|---|
| 1 | 726 | 6.6 | 4.9 | 5.7 | 7.8 | 24.87 | 54.7 |
| 2 | 843 | 6.9 | 5 | 5.9 | 6.97 | 25.41 | 54.1 |
| 3 | 844 | 7.2 | 4.6 | 5.8 | 6.82 | 27.59 | 54.6 |
| 4 | 694 | 7.8 | 5.3 | 6.4 | 9.27 | 28.63 | 47.2 |
| 5 | 763 | 8.8 | 5.2 | 6.8 | 8.87 | 29.54 | 43.8 |
| 6 | 807 | 9 | 5.4 | 7.0 | 8.64 | 30.83 | 46 |
| 7 | 716 | 6.1 | 5 | 5.5 | 7.71 | 26.68 | 76.5 |
| 8 | 777 | 6.2 | 5 | 5.6 | 7.17 | 27.79 | 67 |
| 9 | 770 | 6.2 | 4.9 | 5.5 | 7.16 | 28.69 | 63.4 |

Example 2

Additional one ply UCTAD tissue webs and products were produced in a manner substantially similar to that of Example 1. In certain instances the softwood portion of the furnish was refined or starch was added to the middle layer of the three layer structure to control strength as indicated in Table 7, which sets forth the furnish conditions for each of the samples.

TABLE 7

| Sample | Furnish Layering (wt %) | Redibond 2038 A (kg/ton) | Refining (gap, HDP/MT) |
|---|---|---|---|
| Control 10 | EHWK (30)/NSWK (40)/EHWK (30) | 2.5 | 121.945, 1.1 |
| Inventive 10 | EHWK (30)/NSWK (40)/EHWK (30) | 2.5 | 121.737, 3.4 |

The effect of LC SSWK fibers on various tissue product strength and durability properties is summarized in the tables below.

TABLE 8

| Sample | Plies | Basis Weight (gsm) | GMT (g/3") | Sheet Bulk (g/cm$^3$) | ISO Opacity (%) |
|---|---|---|---|---|---|
| Control 10 | 1 | 40.4 | 1008 | 16.35 | 66 |
| Inventive 10 | 1 | 40.2 | 1211 | 17.62 | 65 |

TABLE 9

| Sample | GMT (g/3") | CD Tear (g) | CD Tear Index | CD TEA (g · cm/cm$^2$) | CD TEA Index | Peak Burst Strength (g) | Burst Index |
|---|---|---|---|---|---|---|---|
| Control 10 | 1008 | 15.75 | 15.63 | 5.740 | 5.69 | 951 | 9.44 |
| Inventive 10 | 1211 | 19.48 | 16.09 | 6.675 | 5.51 | 1099 | 9.08 |

TABLE 10

| Sample | GMT (g/3") | CD Slope (kg) | MD Slope (kg) | GM Slope (kg) | Stiffness Index | Durability Index |
|---|---|---|---|---|---|---|
| Control 10 | 819 | 3.89 | 8.00 | 5.578 | 5.53 | 30.76 |
| Inventive 10 | 808 | 3.68 | 10.04 | 6.078 | 5.02 | 30.68 |

Example 3

One and two-ply UCTAD tissue webs were made generally in accordance with U.S. Pat. No. 5,607,551. The tissue webs and resulting tissue products were formed from various fiber furnishes including EHWK, NSWK, and low-coarseness SSWK ("LC SSWK"). The NSWK had a length-weighted fiber length of about 2.25 mm and a fiber coarseness of about 14.8 mg/100 m. The LC SSWK had a length-weighted fiber length of about 2.5 mm and a fiber coarseness of about 19 mg/100 m. In certain instances the softwood portion of the furnish was refined or starch was added to the middle layer of the three layer structure to control strength as indicated in Table 11, which sets forth the furnish conditions for each of the samples.

TABLE 11

| Sample | Furnish Layering (wt %) | Redibond 2038 A (L/min) | Refining (HPD/ton) |
|---|---|---|---|
| Inventive 11 | EHWK (35)/NSWK (30)/EHWK (35) | 52 | 1 |
| Control 11 | EHWK (35)/LC SSWK (30)/EHWK (30) | 54 | 1 |
| Control 12 | EHWK (29.5)/NSWK (41)/EHWK (29.5) | 20 | 1 |
| Inventive 12 | EHWK (29.5)/LC SSWK (41)/EHWK (29.5) | 28 | 1 |

The stock solutions were pumped to a 3-layer headbox after dilution to 0.75 percent consistency to form a three layered tissue web. EHWK fibers were disposed on the two outer layers and softwood fibers (NSWK or low-coarseness SSWK) were disposed in the middle layer. The relative weight percentage of the layers was 33% (air Layer)/34% (middle layer)/33% (fabric layer). The basesheet basis weight for one ply samples was about 40 gsm and about 42 gsm for two-ply samples. The formed web was non-compressively dewatered and rush transferred to a transfer fabric traveling at a speed about 28 percent slower than the forming fabric. The transfer vacuum at the transfer to the TAD fabric was maintained at approximately 6 inches of mercury vacuum to control molding to a constant level. The web was then transferred to a throughdrying fabric, dried and wound into a parent roll. The parent rolls were then converted into one or two-ply bath tissue rolls. Calendering was done with a steel-on-rubber setup. The rubber roll used in the converting process had a hardness of 40 P&J. The rolls were converted to a diameter of about 117 mm with Kershaw firmness target of about 6 mm and a target roll weight of about 400 grams.

The effect of LC SSWK fibers on various tissue product strength and durability properties is summarized in the tables below.

TABLE 12

| Sample | Plies | Basis Weight (gsm) | GMT (g/3") | Sheet Bulk (g/cm$^3$) | ISO Opacity (%) |
|---|---|---|---|---|---|
| Inventive 11 | 1 | 40 | 819 | 11.52 | 67 |
| Control 11 | 1 | 37.8 | 808 | 11.54 | 66 |
| Control 12 | 2 | 41.8 | 899 | 12.22 | 68 |
| Inventive 12 | 2 | 44.1 | 810 | 12.03 | 69 |

TABLE 13

| Sample | GMT (g/3") | CD Tear (g) | CD Tear Index | CD TEA (g · cm/cm$^2$) | CD TEA Index | Peak Burst Strength (g) | Burst Index |
|---|---|---|---|---|---|---|---|
| Inventive 11 | 819 | 17.08 | 20.9 | 5.262 | 6.4 | 679 | 8.3 |
| Control 11 | 808 | 15.20 | 18.8 | 5.221 | 6.5 | 691 | 8.6 |
| Control 12 | 899 | 23.1 | 25.7 | 6.037 | 6.7 | 956 | 10.6 |
| Inventive 12 | 810 | 21.18 | 26.1 | 5.867 | 7.2 | 843 | 10.4 |

TABLE 14

| Sample | GMT (g/3") | GM slope (kg) | Stiffness Index | Durability Index |
|---|---|---|---|---|
| Inventive 11 | 819 | 6.258 | 7.64 | 35.6 |
| Control 11 | 808 | 6.141 | 7.60 | 33.8 |
| Control 12 | 899 | 7.037 | 7.83 | 43.0 |
| Inventive 12 | 810 | 6.944 | 8.57 | 43.8 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product having a TS750 value less than about 50 dB V2 rms and a CD Tear Index greater than about 13.

In a second embodiment the present invention provides the tissue product of the first embodiment having a Burst Index greater than about 7.5.

In a third embodiment the present invention provides the tissue product of the first or the second embodiments having a CD TEA Index greater than about 6.5.

In a fourth embodiment the present invention provides the tissue product of any one of the first through the third embodiments having a Durability Index greater than about 45.

In a fifth embodiment the present invention provides the tissue product of any one of the first through the fourth embodiments wherein the TS750 value is from about 40 to about 45 dB V2 rm.

In a sixth embodiment the present invention provides the tissue product of any one of the first through the fifth embodiments having a GMT from about 700 to about 1200 g/3" and more preferably from about 700 to about 1000 g/3" and still more preferably from about 750 to about 900 g/3".

In a seventh embodiment the present invention provides the tissue product of any one of the first through the sixth embodiments comprising at least about 5 percent, by weight of the tissue product, Southern softwood kraft fibers.

In an eighth embodiment the present invention provides the tissue product of any one of the first through the seventh embodiments comprising Southern softwood kraft fibers having a coarseness less than about 21 mg/100 m, such as from about 17 to about 21, and a fiber length greater than about 2.2 mm.

In a ninth embodiment the present invention provides the tissue product of any one of the first through the eighth embodiments wherein the tissue product comprises less than about 5 percent, by weight of the tissue product, NSWK fibers.

In a tenth embodiment the present invention provides the tissue product of any one of the first through the ninth embodiments wherein the tissue product is substantially free from NSWK fibers.

In an eleventh embodiment the present invention provides a tissue product comprising at least one multi-layered through-air dried tissue web comprising a first and a second layer, the second layer comprising low-coarseness SSWK fibers, the tissue product having a Durability Index greater than about 28, such as from about 28 to about 45 and more preferably from about 30 to about 45, and a TS750 value less than about 50 dB V2 rms, such as from about 40 to about 50 dB V2 rms and more preferably from about 44 to about 47 dB V2 rms.

In a twelfth embodiment the present invention provides a multi-ply tissue product wherein at least one ply comprises SSWK fibers, the tissue product having a Durability Index greater than about 40 and a TS750 value less than about 50 dB V2 rms, such as from about 40 to about 50 dB V2 rms and more preferably from about 44 to about 47 dB V2 rms.

In a thirteenth embodiment the present invention provides the multi-ply tissue product of the twelfth embodiment having a Burst Index greater than about 10.0.

In a fourteenth embodiment the present invention provides the multi-ply tissue product of the twelfth or the thirteenth embodiments having a CD TEA Index greater than about 6.5.

In a fifteenth embodiment the present invention provides the multi-ply tissue product of any one of the eleventh through the fourteenth embodiments having a Durability Index greater than about 45.

In a sixteenth embodiment the present invention provides the multi-ply tissue product of any one of the eleventh through the fifteenth embodiments wherein the TS750 value is from about 40 to about 45 dB V2 rm.

In a seventeenth embodiment the present invention provides the multi-ply tissue product of any one of the eleventh through the sixteenth embodiments wherein the product has a GMT from about 700 to about 1200 g/3" and more preferably from about 700 to about 1000 g/3" and still more preferably from about 750 to about 900 g/3".

In an eighteenth embodiment the present invention provides the multi-ply tissue product of any one of the eleventh through the seventeenth embodiments wherein at least one ply comprises at least greater than about 5 percent, by weight of the ply, Southern softwood kraft fibers having a coarseness less than about 21 mg/100 m, such as from about 17 to about 21, and a fiber length greater than about 2.2 mm.

In an nineteenth embodiment the present invention provides the multi-ply tissue product of any one of the eleventh through the eighteenth embodiments wherein the tissue product comprises less than about 5 percent, by weight of the tissue product, NSWK fibers.

What is claimed is:

1. A through-air dried tissue product comprising greater than 10 percent, by weight of the web, Southern softwood (SSW) fibers having a coarseness from about 16 to about 19.5 mg/100 m, the tissue product having a TS750 value less than about 50 dB V2 rms and a cross-machine direction (CD) Tear Index greater than about 13.

2. The tissue product of claim 1 having a Burst Index greater than about 7.5.

3. The tissue product of claim 1 having a cross-machine direction tensile energy absorption (CD TEA) Index greater than about 6.5.

4. The tissue product of claim 1 having a Durability Index greater than about 28.

5. The tissue product of claim 1 wherein the TS750 value is from about 40 to about 45 dB V2 rms.

6. The tissue product of claim 1 having a geometric mean tensile (GMT) from about 600 to about 1000 g/3".

7. The tissue product of claim 1 comprising from about 30 to about 40 percent, by weight of the tissue product, Southern softwood kraft (SSWK) fibers having a coarseness from about 18 to about 19.5 mg/100 m and a fiber length greater than about 2.2 mm.

8. The tissue product of claim 1 wherein the Southern softwood kraft (SSWK) fibers have a coarseness from about 18 to about 19.5 mg/100 m and a fiber length from about 2.2 to about 2.8 mm.

9. The tissue product of claim 1 wherein the tissue product comprises less than about 5 percent, by weight of the tissue product, Northern softwood kraft (NSWK) fibers.

10. The tissue product of claim 1 wherein the tissue product is substantially free from Northern softwood kraft (NSWK) fibers.

11. A tissue product comprising at least one multi-layered through-air dried tissue web comprising a first and a second layer, the second layer comprising low-coarseness Southern softwood kraft (SSWK) fibers having a coarseness from about 16 to about 19.5 mg/100 m, the tissue product having a Durability Index greater than about 28 and a TS750 value less than about 50 dB V2 rms, wherein the at least one multi-layered through-air dried tissue web comprises from about 10 to about 40 percent, by weight of the web low-coarseness SSWK.

12. The tissue product of claim 11 having a CD Tear Index greater than about 13.

13. The tissue product of claim 11 having a Burst Index greater than about 7.5.

14. The tissue product of claim 11 having a cross-machine direction tensile energy absorption (CD TEA) Index greater than about 6.5.

15. The tissue product of claim 11 wherein the TS750 value is from about 40 to about 45 dB V2 rms.

16. The tissue product of claim 11 having a geometric mean tensile (GMT) from about 600 to about 1000 g/3".

17. The tissue product of claim 11 wherein the tissue product comprises from about 30 to about 40 percent, by weight of the tissue product, low-coarseness Southern softwood kraft (SSWK) fibers.

18. A through-air dried tissue product comprising from about 10 to about 40 percent, by weight of the web, low-coarseness Southern softwood (SSW) fibers having a coarseness from about 16 to about 19.5 mg/100 m, the tissue product having a geometric mean tensile (GMT) from about 750 to about 950 g/3", a Durability Index greater than about 28 and a TS750 value less than about 50 dB V2 rms, wherein the product is substantially free from Northern softwood kraft (NSWK).

19. The tissue product of claim 18 having a Burst Index greater than about 7.5.

20. The tissue product of claim 18 having a cross-machine direction tensile energy absorption (CD TEA) Index greater than about 6.5.

* * * * *